US005463709A

United States Patent [19]

Terao et al.

[11] Patent Number: 5,463,709

[45] Date of Patent: Oct. 31, 1995

[54] END-FACE POLISHED FERRULE AND ITS METHOD OF MANUFACTURE

[75] Inventors: Kazuhiko Terao; Hidetoku Iida; Takeyasu Nakayama; Toshiya Kubo; Jiro Horigome, all of Nagano; Yoshihiro Matsuoka, Chiba; Nobutoshi Takeda, Chiba; Tohru Mizuhashi, Chiba, all of Japan

[73] Assignees: Totoku Electric Co., Ltd.; Emit Seiko Co., Ltd., both of Tokyo, Japan

[21] Appl. No.: 317,072

[22] Filed: Oct. 3, 1994

[30] Foreign Application Priority Data

Dec. 10, 1993 [JP] Japan ..... 5-310266

[51] Int. Cl.[6] ..... G02B 6/36; G02B 6/25

[52] U.S. Cl. ..... 385/85; 385/77; 385/78

[58] Field of Search ..... 385/76, 77, 78, 385/80, 85, 38; 65/385, 402; 51/293

[56] References Cited

U.S. PATENT DOCUMENTS

| | | | |
|---|---|---|---|
| 4,084,308 | 4/1978 | Runge | 385/85 |
| 4,763,980 | 8/1988 | Gerber et al. | 385/85 X |
| 4,787,698 | 11/1988 | Lyons et al. | 385/85 X |
| 4,802,726 | 2/1989 | Palmquist et al. | 385/85 X |
| 4,839,993 | 6/1989 | Masuko et al. | 51/129 |
| 5,062,682 | 11/1991 | Marazzi | 385/85 |
| 5,193,133 | 3/1993 | Schofield et al. | 385/85 |
| 5,245,684 | 9/1993 | Terao et al. | 385/78 |
| 5,333,223 | 7/1994 | Schofield et al. | 385/84 |
| 5,351,327 | 9/1994 | Lurie et al. | 385/78 |
| 5,402,508 | 3/1995 | O'Rourke et al. | 385/31 |

FOREIGN PATENT DOCUMENTS

| | | | |
|---|---|---|---|
| 59-38707 | 3/1984 | Japan | 385/85 X |

*Primary Examiner*—Brian Healy

*Attorney, Agent, or Firm*—Jordan and Hamburg

[57] ABSTRACT

End face of a ferrule 100 is polished to form a conical surface 3 such that, central axis Ap of said conical surface 3 makes an inclination of 8° with respect to central axis L of optical fiber insertion hole 4, top 3*t* of said conical surface 3 coincides with said central axis L and has a taper angle of 2°. Because of this, while polishing an end of a optical fiber inserted and fixed inside said optical fiber insertion hole 4, a well balanced oblique spherical surface can be formed and the non-coincidence of the center of said oblique convex surface with the point where said oblique convex surface intersect with the optical axis of said optical fiber can be prevented.

9 Claims, 11 Drawing Sheets

END-FACE POLISHED FERRULE AND ITS METHOD OF MANUFACTURE

BACKGROUND OF THE INVENTION

1. Field of the Invention

Present invention relates to an end face polished ferrule and its method of manufacture. It also relates particularly to a end face polished ferrule and its method of manufacture for improving the connection characteristics of optical fibers in assemblies of the sort used in analog image communications like CATV(CAble TeleVision), very high speed communications and optical amplifiers, or optical fiber assemblies having isolator functions.

2. Description of the Prior Art

The prior art for connecting two optical fibers assemblies, comprising of an optical fiber and a ferrule, with a small connection loss and little light reflected back to the source has been proposed in publications of Laid-open Japanese Patent Application Nos. 87111/1986 and 121805/1989. The objective is achieved by polishing the end faces of both of said optical fiber assemblies to an oblique convex spherical surface and then connecting said optical assemblies by bringing the oblique convex spherical surfaces in contact with each other.

For example, as shown in FIG. 17, to connect the optical fiber assemblies (formed by an optical fiber s and a ferrule 150 and an optical fiber s' and a ferrule 150'), the end faces of said optical fiber assemblies are polished to form oblique spherical surfaces q and q' in such a way that, the line joining the centers of curvature C and C' of said oblique spherical surfaces q and q' makes an angle of 8° with respect to the optical axes L3 and L3' of said optical fibers s and s'.

The foregoing method improves the coincidence of the optical axes of the fibers s and s' and enables light reflected back to the source to be minimized.

In conventional optical connector end-face polishing methods, the convex spherical surface q is formed according to the procedure mentioned below.

In the beginning, as shown in FIG. 18(*a*), an optical assembly is formed by bonding a fiber s and a conically tapered ferrule 150 with a reinforced adhesive.

Next, as shown in FIG. 18(*b*), said optical fiber assembly is rotated around a vertical axis of rotation after inclining it by an angle of 8° on a polishing disc (not shown in the figure), thereby forming an oblique horizontal surface 151 at the tip of the optical fiber assembly. Because the tip of the ferrule 150 is cut into a conical shape, 151*t*, the center of the oblique horizontal surface 151 is offset from the point P where the optical axis of the optical fiber s intersects with the surface 151.

Hereafter, as shown in FIG. 18(*c*), said optical fiber assembly in its inclined position is rotated around a vertical axis of rotation on a polishing disc with an elastic abrasive disc mounted (not shown in the figure) on it, thereby forming a oblique convex spherical surface q at the tip of it.

In the aforementioned conventional end face polished optical fiber assembly, qt, the center of the oblique convex spherical surface q is offset from the point P as shown in FIG. 19, because the position of qt, the center of said surface affects 151*t*, the center of the horizontal surface 151, and because the contact with the polishing disc mounted with an elastic abrasive disc creates an unbalance due to the inclination of the ferrule f (for instance, when the angles at the corners 150*a* and 150*b* are different). Due to this, stabilization and minimization of insertion loss and light reflected back to the source becomes difficult.

SUMMARY OF THE INVENTION

In view of the foregoing, it is the object of the present invention to provide an end-face polished ferrule and a method of manufacturing said ferrule of an optical fiber assembly wherein the offset between the center of the oblique convex spherical surface of said ferrule and the optical axis point of the optical fiber is prevented, and stabilization and minimization of insertion loss and light reflected back to the source are effected.

It is the first object of this invention to provide an end-face polished ferrule, polished to form a conical surface at the end face, such that; central axis of said conical surface makes an inclination of θ° with respect to axis of optical fiber insertion hole, the top of said conical surface coincides with said axis of optical fiber insertion hole and has a taper angle of α°.

The second object of the present invention is to provide an end-face polished ferrule described in the first object, comprising; a flange with four key slots spaced at 90° intervals for accommodating keys provided in a housing for said ferrule, wherein, the key slots facing each other having the same slot width while the key slots adjacent to each other having different slot width, and out of the two planes which contain the opposite key slots, one of the planes coincides with the plane containing said axis of optical fiber insertion hole and said central axis while the other plane is orthogonal thereto.

It is the third object of this invention to provide a method of manufacturing an end-face polished ferrule, wherein; a spindle rotates around an axis of rotation which makes an angle of α° with respect to a line vertically erected on a plane polishing surface, and retains a ferrule with unpolished end face wherein axis of optical fiber insertion hole of said ferrule makes an inclination of θ° with respect to said axis of rotation, unpolished end face of said ferrule is brought into contact with said polishing surface and polished into a conical surface until the axis of optical fiber insertion hole of the ferrule coincides with the top of said conical surface.

According to the aforementioned first object of the present invention, an end-face of a ferrule is polished to form a conical surface at the end face, such that, central axis of said conical surface makes an inclination of θ° with respect to axis of optical fiber insertion hole, the top of said conical surface coincides with said axis of optical fiber insertion hole and has a taper angle of α°.

Thereafter, an optical fiber is inserted and secured in said ferrule to form an optical fiber assembly, and the tip of said optical fiber assembly is polished to a convex spherical surface wherein the central axis is inclined at an angle of θ° with respect to the optical axis of the optical fiber.

During polishing of the end face to obtain the spherical surface, the polishing process is carried out from both the top and the edge of the conical surface, thereby forming an oblique convex spherical surface with satisfactory balance, having a center which is not offset from the optical axis point of the optical fiber, and enabling the insertion loss and light reflected back to the source to be stabilized and minimized.

Furthermore, there is an advantage that, during the connection of the optical fiber on a site, said end-face polished ferrule may be taken to the site, and only polishing of the optical fiber assembly to a spherical end face may be effected on the site, eliminating the need for polishing the oblique conical surface and curtailing the working time on the site.

According to the aforementioned second object of the present invention, in addition to the above-mentioned object, a flange with four key slots spaced at 90° intervals is provided for accommodating keys provided in a housing for said ferrule, wherein, the key slots facing each other having the same slot width while the key slots adjacent to each other having different slot width, and out of the two planes which contain the opposite key slots, one of the planes coincides with the plane containing said axis of optical fiber insertion hole and said central axis while the other plane is orthogonal thereto.

Therefore, this end-faced polished ferrule can be used in two types of housings.

According to the aforementioned third object of the present invention, in the method of manufacturing the end-face polished ferrule, using a spindle which rotates around an axis of rotation which makes an angle of α° with respect to a line vertically erected on a plane polishing surface, and retains a ferrule with unpolished end face wherein axis of optical fiber insertion hole of said ferrule makes an inclination of θ° with respect to said axis of rotation, the tip of said ferrule with an unpolished end face of said ferrule is brought into contact with said polishing surface and polished into a conical surface until the axis of optical fiber insertion hole of the ferrule coincides with the top of said conical surface.

Thereby, the end-face polished ferrule, according to the above-mentioned first object of the invention, can be manufactured satisfactorily.

SPECIFIC DESCRIPTION OF THE EMBODIMENT

The present invention will hereinafter be described in more detail by way of illustrative embodiments. However, it must be understood that these embodiments are intended to illustrate the invention and are not to be construed to limit the scope of the invention.

Figure 1:
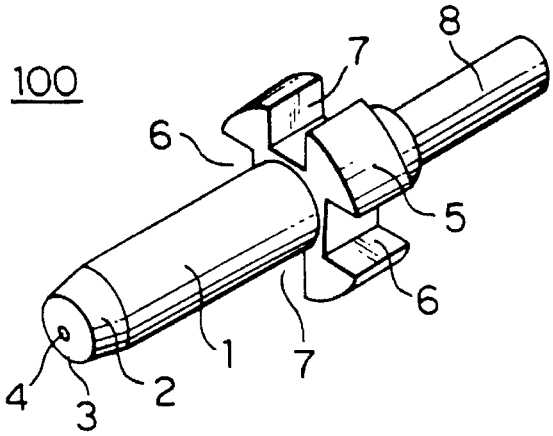
FIG. 1 is a perspective view of the end-face polished ferrule according to an embodiment of this invention.
Figure 2:
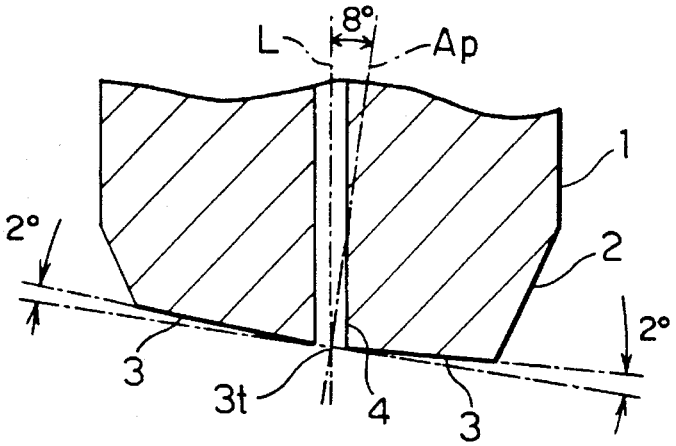
FIG. 2 is a cross section view of the end-face polished ferrule shown in FIG. 1.

FIG. 1 is a perspective view of the end-face polished ferrule according to an embodiment of the present invention. FIG. 2 is a cross section view of the tip of the ferrule of FIG. 1.

The area in the vicinity of the tip of body 1 of the ferrule 100 is chamfered to a conical surface 2 having a taper angle of 60°, and the tip of said body 1 is formed into a conical surface 3. Said conical surface 3 has a central axis Ap inclined at an angle of 8° with respect to the axis L of the optical fiber insertion hole 4, and the axis L of the optical fiber insertion hole 4 coincides with the top 3*t*, and has a taper angle of 2°. The top 3*t* has an imaginary existence.

The optical fiber insertion hole 4 has been drilled such that it passes through the body 1 from the aforementioned top 3*t* of the conical surface 3. The diameter of the optical fiber insertion hole 4 is approximately 125 μm (which is nearly equal to the diameter of optical fiber). The central axis of the ferrule 100 coincides with the central axis L of the optical fiber insertion hole 4.

Said body 1 has a flange 5 attached thereto. Said flange 5 is provided with key slots 6, 6, and 7, 7. The optical fiber cable (not shown in figure) is passed through 8, a cylindrical part integral with the flange 5, before the spherical polishing process described hereafter starts. The internal diameter of the cylindrical part 8 is approximately 0.9 mm.

Figure 3:
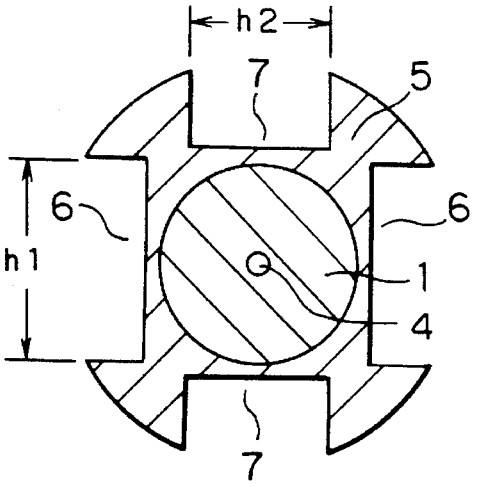
FIG. 3 is a cross section view of the flange part of the end-face polished ferrule shown in FIG. 1.

FIG. 3 is a cross section view of the flange 5 of the ferrule 100.

The key slots 6, 6, 7, 7 are provided at intervals of 90°. Opposing key slots 6, 6 have a slot width h1 of 1.45 mm, and these are the key slots that engage with keys of FC type housings. The plane containing the key slots 6, 6, coincides with the plane containing the axis L of the optical fiber insertion hole and the central axis Ap of the conical surface 3. On the other hand, the opposing key slots 7, 7 have a slot width h2 of 1.3 mm, and these are the key slots that engage with keys of SC type housings. The plane containing the key slots 7, 7 is perpendicular to the plane containing the axis L of the optical fiber insertion hole and the central axis Ap of the conical surface 3.

Only one of the pair of the key slots 6, 6 or 7, 7 may be provided but provision of both pairs are preferred because of compatibility with both types of housing FC type and SC type.

Figure 4:
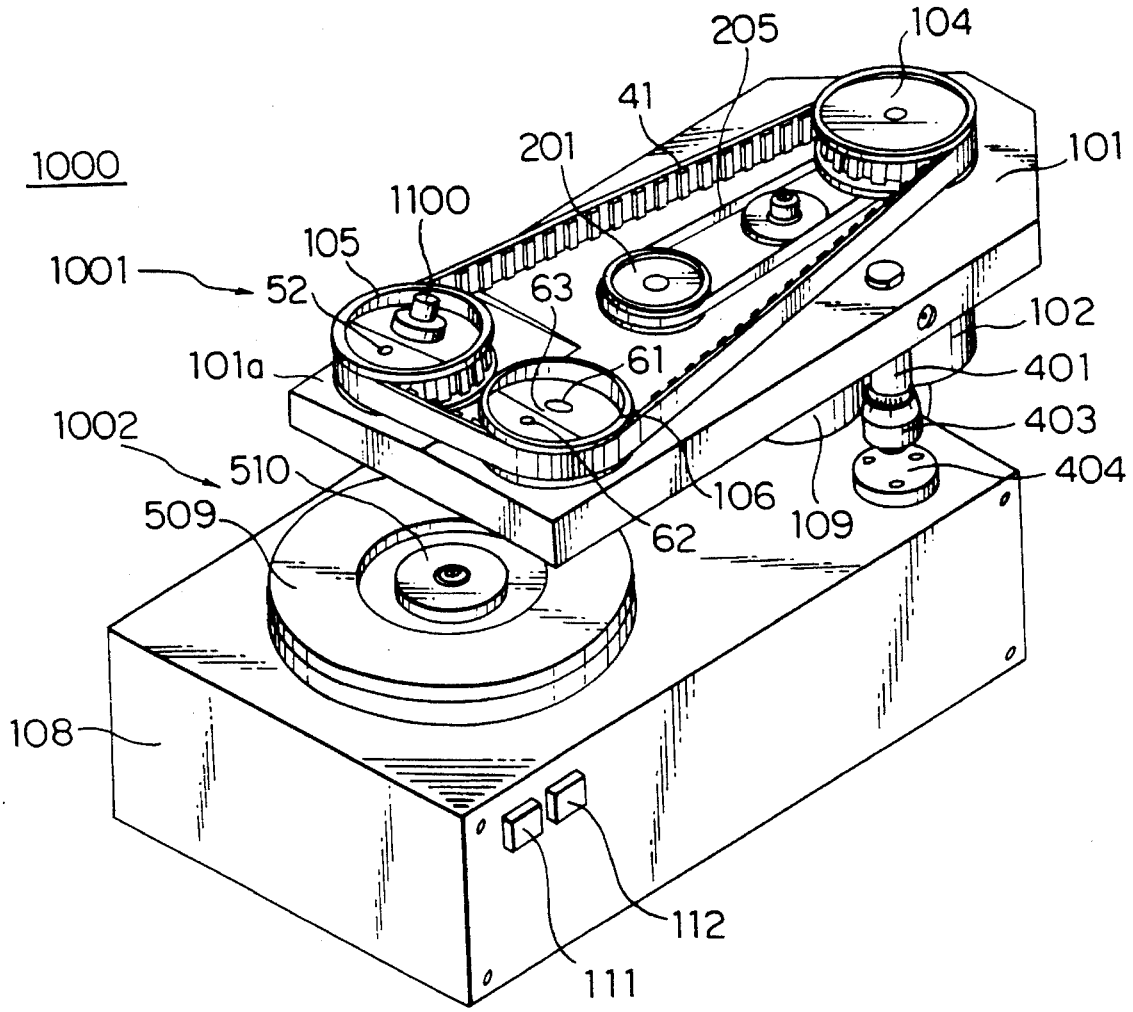
FIG. 4 is a perspective view of the end-face polishing apparatus.
Figure 5:
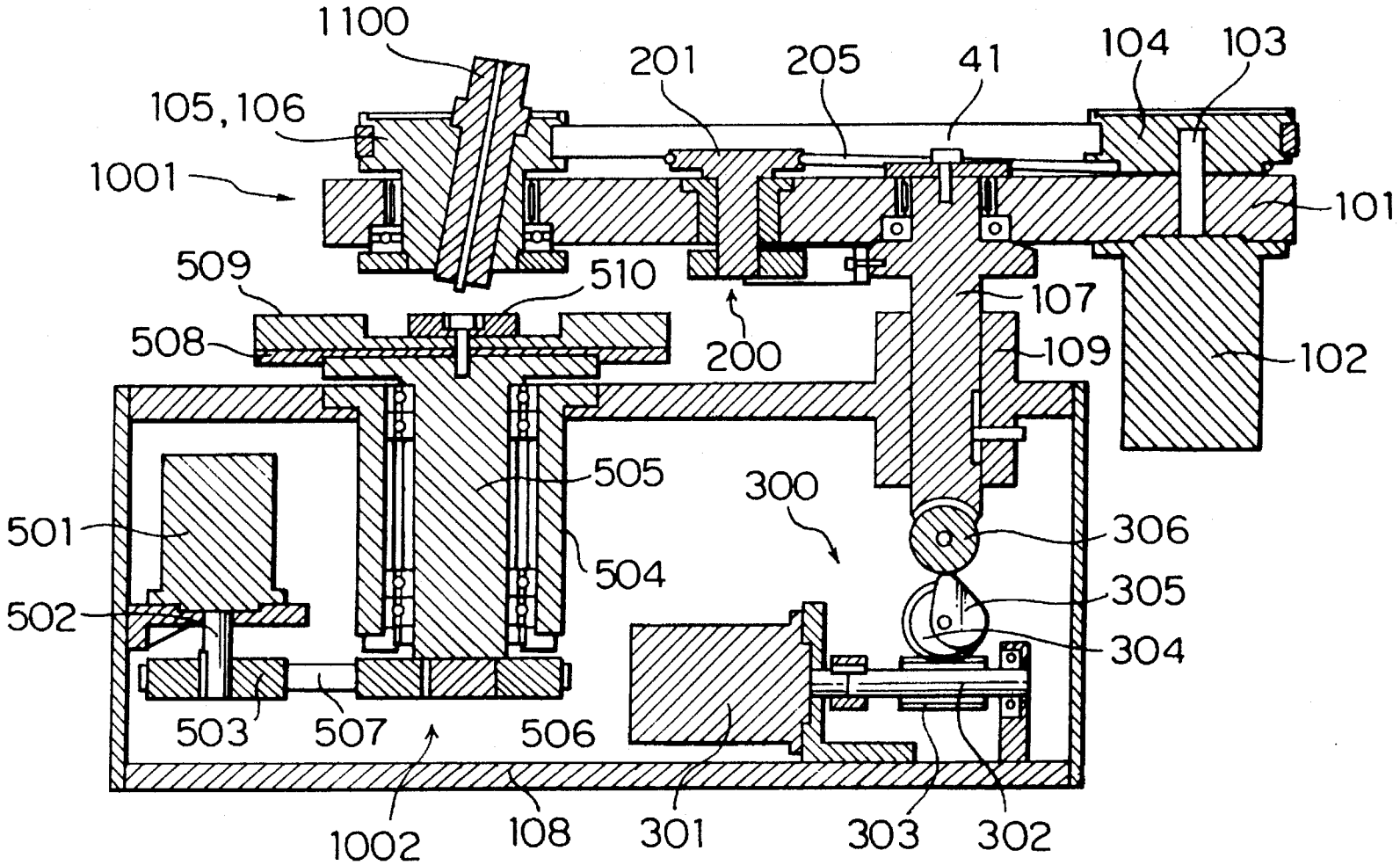
FIG. 5 is a cross section view of the end-face polishing apparatus.

FIG. 4 is a perspective view of the end-face polishing apparatus 1000 used to manufacture the ferrule 100. FIG. 5 is a cross section view of said end-face polishing apparatus 1000. Said end-face polishing apparatus 1000 can also be used for spherical polishing of the optical fiber assembly.

The end face polishing apparatus 1000 comprises a jig unit 1001 and a polishing unit 1002.

Reference numeral 108 designates a case, reference numeral 111 designates a power switch and reference numeral 112 designates a start switch.

Said jig unit 1001 has a jig plate 101, with a reversible motor 102 mounted thereon. A spindle pulley 104 is mounted on motor shaft 103 of said reversible motor 102.

Reference numeral 101*a* is an oblique surface. This oblique surface 101*a* makes an angle of 2° with respect to a polishing disc 509, however, said jig plate 101 is horizontal with respect to said polishing disc 509.

The oblique surface 101*a* comprises a reversible spindle 105 for polishing into an oblique conical surface. Accordingly, axis of rotation (Ap in FIG. 9) of the reversible spindle 105 is inclined at an angle of 2° with respect to a line (V in FIG. 9) vertically erected on the polishing disc 509. Said jig plate 101 also comprises a reversible spindle 106 for polishing into a spherical surface. However, axis of rotation (As in FIG. 9) of said reversible spindle 106 coincides with the line V.

Tooth profiles have been cut in said spindle pulley 104 and the reversible spindles 105 and 106, and a timing belt 41 is stretched around said spindle pulley 104 and said spindles 105 and 106. An idler (not shown in the figures) may be provided if necessary.

Reference numeral 1100 designates a collet chuck sleeve (mounted on the reversible spindle 105 in FIG. 4) which can be freely mounted on or dismounted from the reversible spindles 105 or 106.

Figure 9:
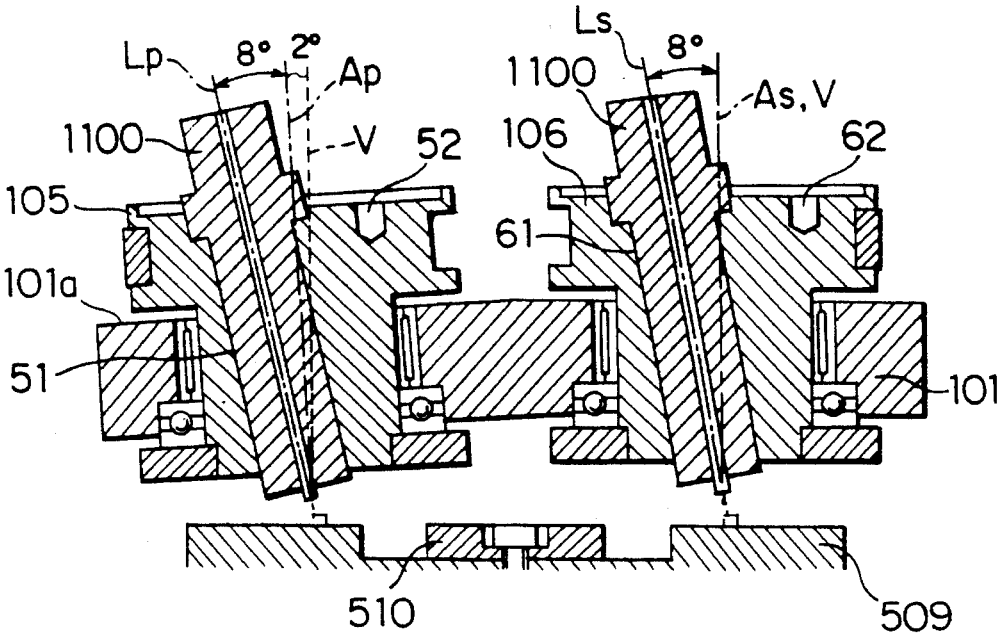
FIG. 9 is a cross section view in the vicinity of the reversible spindle.

Reference numeral 51 (not shown in FIG. 4 and FIG. 5. Refer to FIG. 9), and reference numeral 61 designate insertion holes wherein said collect chuck sleeve 1100 can be inserted. Reference numerals 52 and 62 designate bolt holes to accommodate bolts (not shown in the figures) for securing said collect chuck sleeve 1100. Reference numerals 53 (not shown in the figures) and 63 designate key slots for locking the rotation of the collect chuck sleeve 1100.

Figure 6:
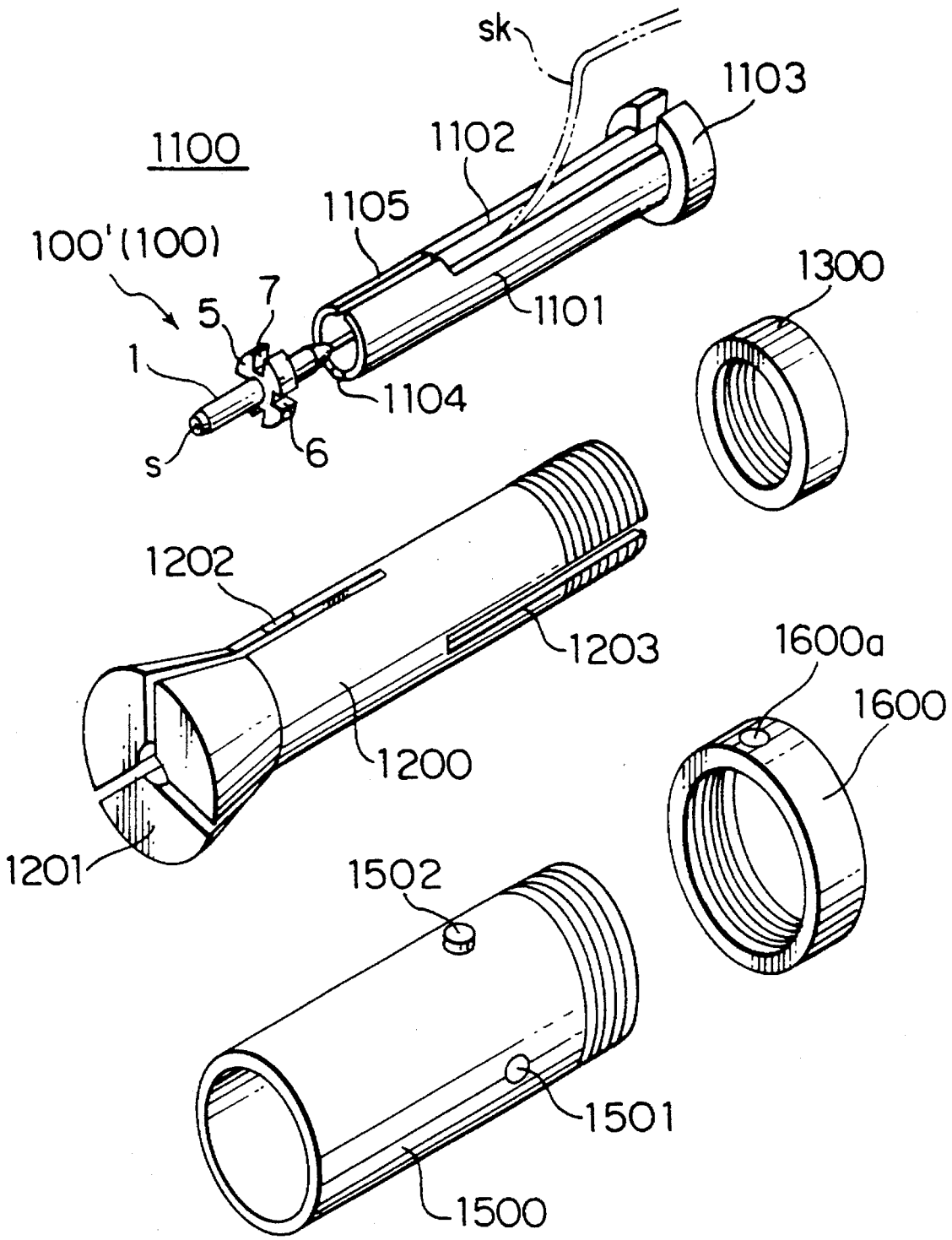
FIG. 6 is an exploded view in perspective of the collect chuck sleeve.
Figure 7:
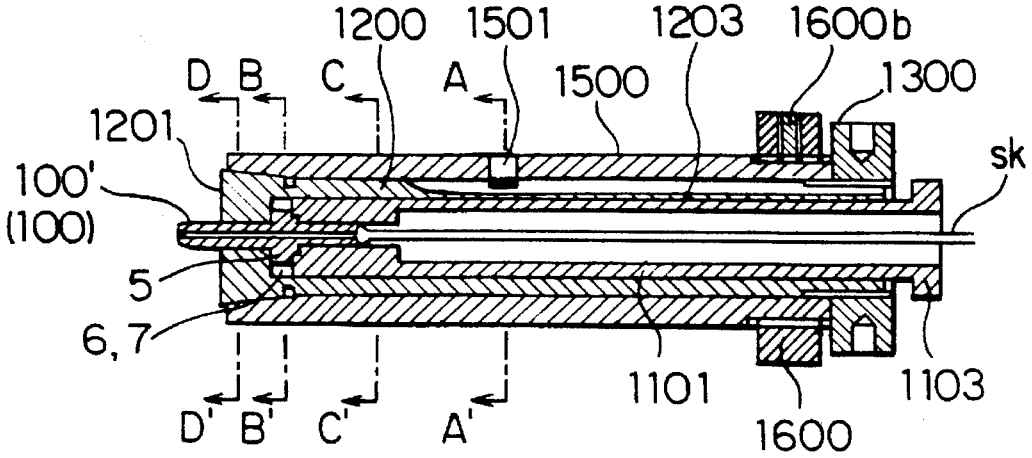
FIG. 7 is a cross section view of the collet chuck.
Figure 8A:
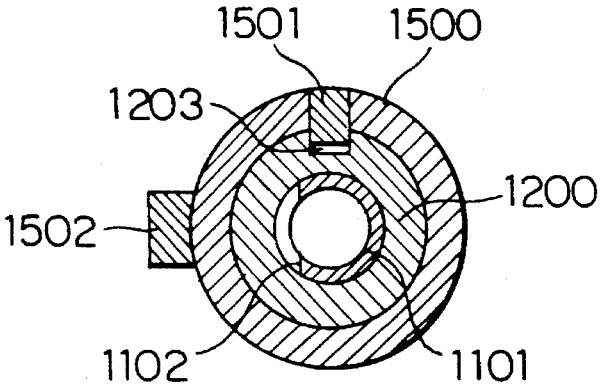
FIG. 8 (*a*) is the cross section view at A—A' shown in FIG. 7, 8(*b*) is the cross section view at B—B' shown in FIG. 7, 8(*c*) is the cross section view at C—C' shown in FIG. 7, finally, 8(*d*) is the cross section view at D—D' shown in FIG. 7.
Figure 8C:
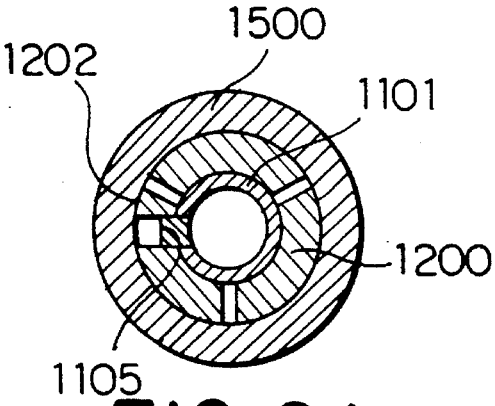
Figure 8B:
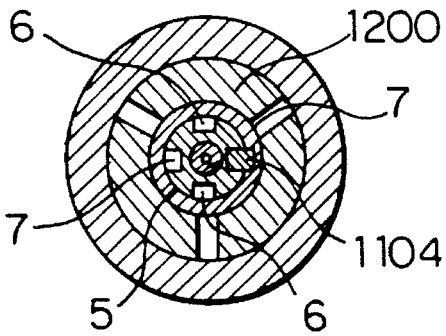
Figure 8D:
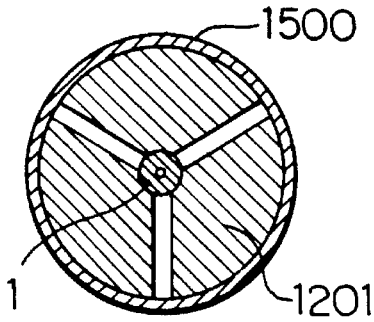

FIG. 6 is an exploded view in perspective of the collet chuck sleeve 1100. FIG. 7 is a cross section view of the assembly of said collet chuck sleeve 1100.

This collect chuck sleeve 1100 comprises an optical fiber positioning sleeve 1101, a collet unit sleeve 1200 and collet tightening nut 1300, a sleeve 1500 and a collet chuck sleeve height-adjusting nut 1600.

Said optical fiber positioning sleeve 1101 comprises a key slot 1105, a ferrule slot 1102, and a flange 1103. A protruding claw 1104 is provided on the side opposite to the flange 1103 which couples the flange 1103 and the slots 6 or 7 of the ferrule 100.

A collet 1201, a key 1202 (protruding inward), and a key slot 1203 are provided in said collet unit sleeve 1200.

A key 1501 (protruding inward) and a key 1502 are provided in said sleeve 1500.

A bolt hole 1600*a* (bolt is 1600*b* in FIG. 7) is provided in said collet chuck sleeve height-adjusting nut 1600 to lock said nut and to prevent it from rotation with respect to said sleeve 1500.

For assembling the collet chuck sleeve 1100, first the collet unit sleeve 1200 is inserted in the sleeve 1500, such that the key 1501 is positioned in the key slot 1203 (refer to FIG. 8(*a*), which is the cross section view at A—A' shown in FIG. 7). Next, the collet chuck sleeve height-adjusting nut 1600 is screwed in until the specified position on the sleeve 1500, and secured by bolt 1600*b*. The collet tightening nut 1300 is loosely screwed on said collet unit sleeve 1200.

The end-faced polished ferrule 100' is held in place (however, the area in the vicinity of the tip is chamfered to a conical surface) in the optical fiber positioning sleeve 1101 by engaging the protruding claw 1104 in said slots 6 or 7 (refer to FIG. 8(*b*), which is the cross section view at B—B' in FIG. 7).

Next, said optical fiber positioning sleeve 1101, together with said ferrule 100', is inserted in said collet unit sleeve 1200, while positioning said sleeve 1101 such that the key 1202 is engaged with the key slot 1105 (refer to FIG. 8(*c*), which is the cross section view at C—C' shown in FIG. 7). Thereafter, loosely-screwed collet tightening nut 1300 is screwed firmly so that the ferrule 100' is tightened and secured in the collet 1201 (refer to FIG. 8(*d*), which is the cross section view at D—D' shown in FIG. 7).

For polishing into an oblique conical surface described below, the collet chuck sleeve 1100 is inserted in the insertion hole 51 to fit said collet chuck sleeve 1100 in the end-face polishing apparatus 1000, and key 1502 is engaged in the key slot 53 so that the collet chuck sleeve 1100 and reversible spindle 105 are positioned.

FIG. 9 is a cross section view in the vicinity of the reversible spindles 105 and 106. For convenience, the figure shows the collet chuck sleeve 1100 fitted to both the reversible spindles 105 and 106.

Central axis Lp (same as the central axis L of optical fiber insertion hole 4) of insertion hole 51 is inclined at an angle of 8° with respect to the axis of rotation Ap of the reversible spindle 105. Furthermore, the axis of rotation Ap of the reversible spindle 105, is inclined at an angle of 2° with respect to the line V vertically erected on the polishing disc 509. Therefore, the central axis Lp of the insertion hole 51 makes a total inclination of 10° with respect to said line V.

Referring back to FIG. 4, the jig plate 101 is supported by the feed shaft 107 which can shake the jig plate 101 transversely or move the jig plate 101 vertically. Transverse shaking is performed by a jig plate shaking device 200. Vertical movement is performed by jig unit raising/lowering device 300.

Figure 11:
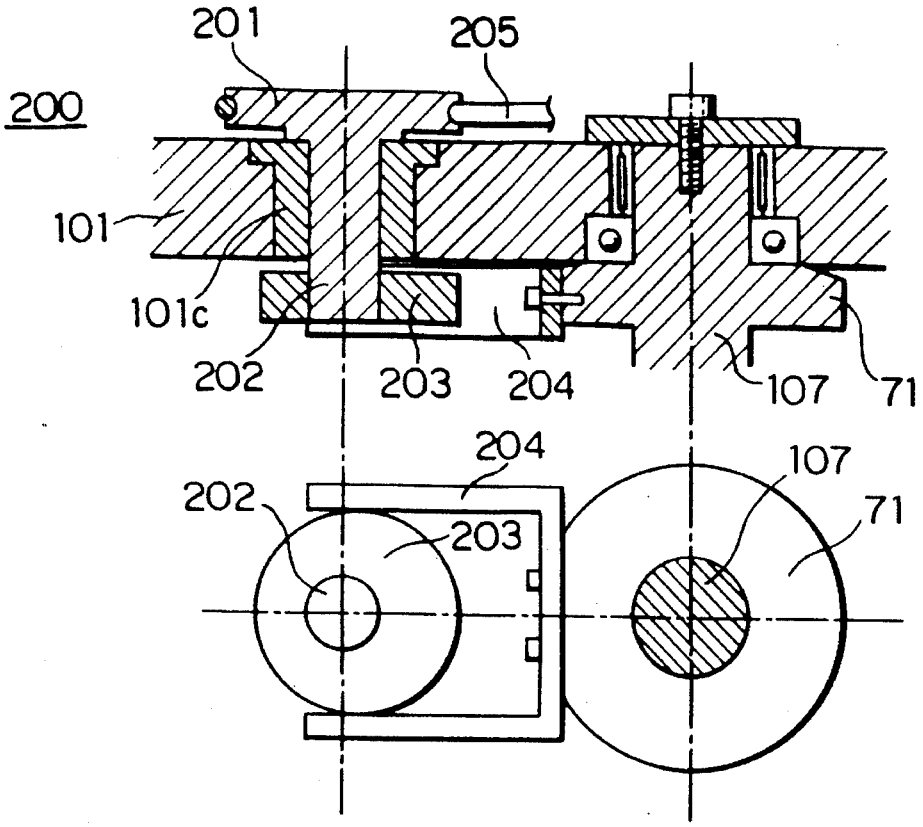
FIG. 11 is a cross section view of the jig unit raising/lowering device.

FIG. 11 is a cross section view of the jig plate shaking device 200.

A pulley 201 is supported by a slide bearing 101*c* of said jig plate 101. An eccentric disc 203 is fixed on a pulley shaking shaft 202. A fork 204 is secured to the flange 71 of the feed shaft 107 by bolts. A shaking cam is formed by comprising said fork 204 and said eccentric disc 203.

As shown in FIG. 1, a rubber belt 205 is stretched around said pulley 201 and the spindle pulley 104. When the spindle pulley 104 rotates due to a drive of the reversible motor 102, the pulley 201; the pulley shaking shaft 202; and the eccentric disc 203 rotates. Moreover, the pulley shaking shaft 202 starts shaking because of the eccentric disc 203 being constrained by the fork 204, thereby causing the jig plate 101 to be shacked transversely.

Figure 10:
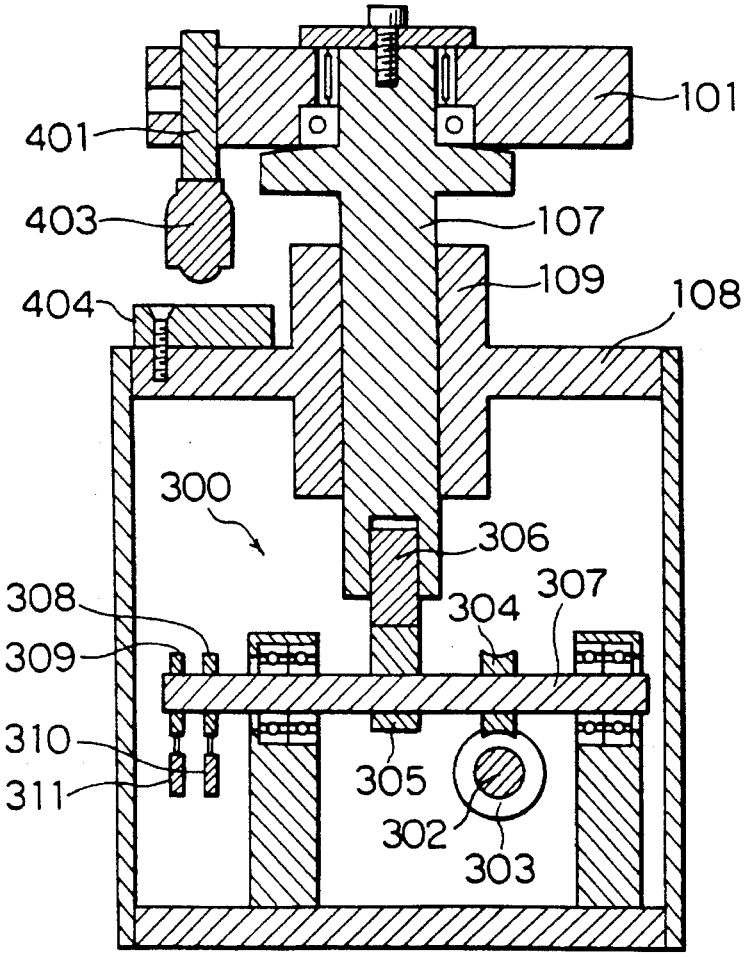
FIG. 10 is a cross section view of the jig plate shaking device.

FIG. 10 is a schematic cross section view of the jig unit raising/lowering device 300. Referring to FIG. 10 and FIG. 5 for further explanation, a roller 306 supported by a cam 305, is fitted at the bottom end of the feed shaft 107. Said cam 305 fitted to a cam shaft 307, is provided with a worm wheel 304. Said worm wheel 304 is engaged with a worm 303 fitted on the motor shaft 302.

When cam 308, meant for detecting a top position, detects the top position and presses a micro-switch 310, a top position detected signal is output.

When cam 309, meant for detecting a bottom position, detects the bottom position and presses a micro-switch 311, a bottom position detected signal is output.

Stopper shaft 401 is secured by screws to the jig plate 101. Bottom end of this stopper shaft 401 is provided with a micrometer head 403. Said micrometer head 403 is stopped by a stopper plate 404 provided on the upper surface of the case 108.

When the motor shaft 302 and the worm 303 are driven by the cam shaft drive motor 301, the worm wheel 304 and the cam shaft 307 rotates, thereby causing the cam 305 to rotate. As the cam 305 rotates, the supporting position of the roller 306 moves up and down causing a vertical motion of the jig plate 101, by a transmission through the feed shaft 107. Lower limit of said vertical motion, however, will be the position decided by the micrometer head 403.

Returning to FIG. 5, in the polishing unit 1002, the polishing disc 509 and a polishing disc stand 508 are secured to the upper end flange of the polishing disc shaft 505 by a retaining plate 510 and a bolt. The polishing disc shaft 505 is rotatably retained in the cylinder 504 which is inserted through the upper surface of the case 108 and secured. A belt pulley 506 is provided at the lower end of the polishing disc shaft 505. Motor shaft 502 of the polishing disc drive motor 501 is also provided with a belt pulley 503. A flat belt 507 is stretched around the belt pulleys 503 and 506.

When the motor shaft 502 and the belt pulley 503 driven by the polishing disc drive motor 501, the belt pulley 506 rotates by a transmission through the flat belt 507, thereby causing the polishing disc shaft 505; the polishing disc stand 508 and the polishing disc 509 to rotate.

Figure 12:
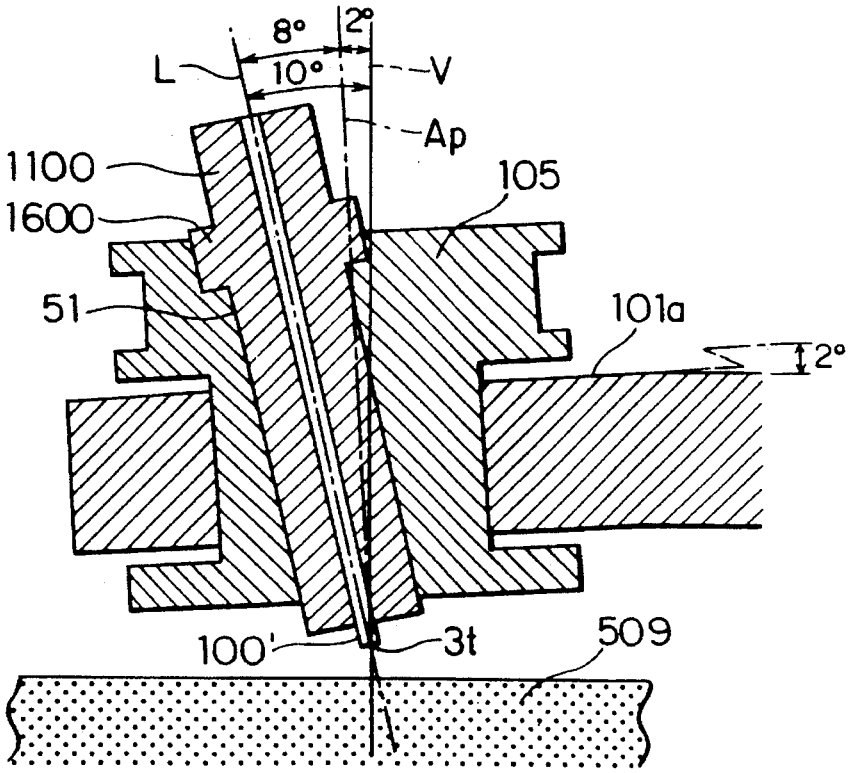
FIG. 12 is a cross section view in the vicinity of the reversible spindle used in the oblique conical surface polishing process.

FIG. 12 is a schematic cross section view for explaining the polishing process (of the ferrule 100) into an oblique conical surface.

Ferrule 100' is secured in the collet chuck sleeve 1100 and inserted in the insertion hole 51 of the reversible spindle 105 for polishing into an oblique conical surface. Central axis L of the optical fiber insertion hole 4 is inclined at an angle of 8° with respect to Ap, the axis of rotation of the reversible spindle 105. Moreover, said axis of rotation Ap is inclined at an angle of 2° with respect to line V vertically erected on the polishing disc 509.

The position of the end face of the ferrule 100' is adjusted using the collet chuck sleeve height-adjusting nut 180. Said position of the end face of the ferrule 100' is so adjusted that the top 3*t* of the central axis L of the insertion hole 4 coincides with the axis of rotation Ap of the reversible spindle 105.

Next, the power switch 111 is turned on to operate reversing spindle 105, polishing disc 509, and jig plate shaking device 200. The reversing spindle 105 switches direction and rotates in the reverse direction every second. During the oblique conical surface end-face polishing process of the ferrule 100', there is no need for reverse rotation, and the spindle may be allowed to be rotated in a single direction only. However, if the spindle is reverse rotated, twisting of the optical fiber can be prevented, it is preferable to effect the oblique conical surface polishing of the integral optical fiber assembly consisting of the end-face unpolished ferrule 100' and the optical fiber. The polishing disc 509 has a rotation speed of 66 m/second at the polishing point and a rotation period of 15 seconds. The jig plate 101 is made to shake transversely to avoid a coincidence of the polishing point at a single location of the polishing disc 509.

Next, the start switch 112 is turned on, the jig unit lowering/raising device 300 lowers the jig unit 1001 and the tip of the ferrule 100' is brought in contact with the polishing disc 509 where it is polished.

At the point when the reversible spindle 105 reverses direction, a pause state occurs because of the inertial moment of the reversible spindle 105, and stretching and elongation of the timing belt 41, which may cause an unbalance in the polishing amount. To suppress such an unbalance, rotation of said reversible spindle 105 is synchronized with a change in the orientation of the central axis L with respect to the axis of rotation Ap. Said reversible spindle 105 rotates in direction in which the angle between the central axis L and the polishing disc 509 is acute.

After every one rotation of the cam 305, above explained process of polishing into an oblique conical surface is terminated automatically and the jig unit 1001 rises.

Figure 13A:
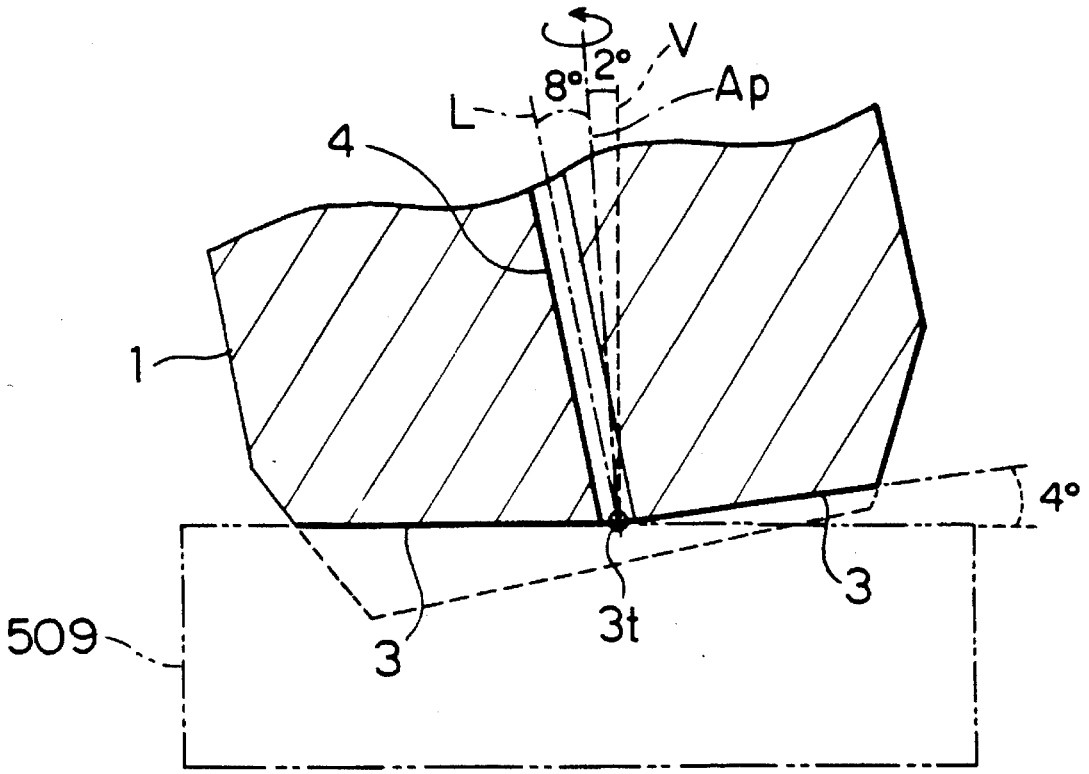
FIGS. 13(*a*)–(*b*) are cross section views for explaining the oblique conical surface polishing process.
Figure 13B:
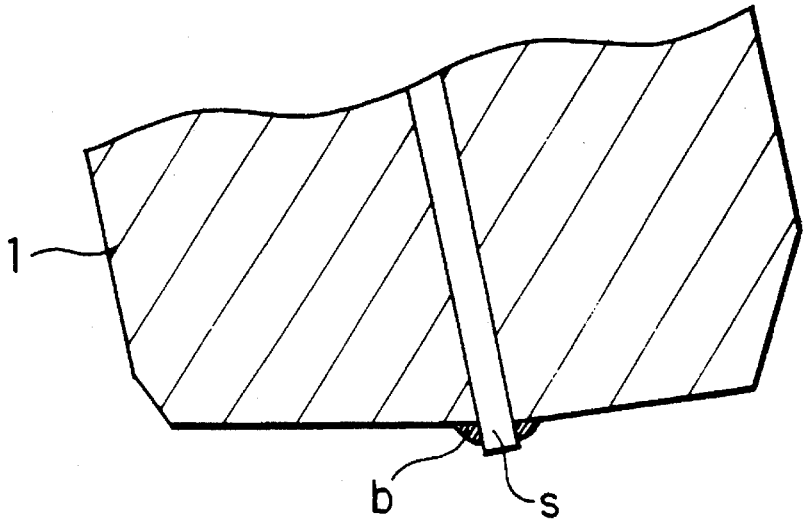

In FIG. 13(*a*) (also FIG. 2) the status at the completion of the oblique conical surface polishing process is shown, moreover, it is shown that the tip of the ferrule 100' cut to a conical surface with a taper angle of 2° with respect to the axis of rotation Ap, and the top 3*t* of the conical surface 3 coinciding with the central axis L of the optical fiber insertion hole 4. The end-face polished ferrule 100 is obtained thereby.

The spherical surface polishing process of the optical fiber assembly using the end-face polished ferrule 100 is explained hereinafter.

In the beginning, as shown in FIG. 13(*b*), an optical assembly is formed by bonding an optical fiber s inserted in the end-face polished ferrule 100 with a reinforced adhesive.

Thereafter, as shown in FIG. 8, said optical fiber assembly is inserted in the tube of the optical fiber positioning sleeve 1101. The optical fiber cable sk is also inserted through the key slot 1105 and ferrule slot 1102 into the tube of the optical fiber positioning sleeve 1101. Next, the optical fiber positioning sleeve 1101 is inserted in the collet unit sleeve 1200. The heretofore loosely-screwed collet tightening nut 1300 is screwed firmly, and the body 1 of the end-face polished ferrule 100 is tightened and secured in the collet 1201.

Figure 14:
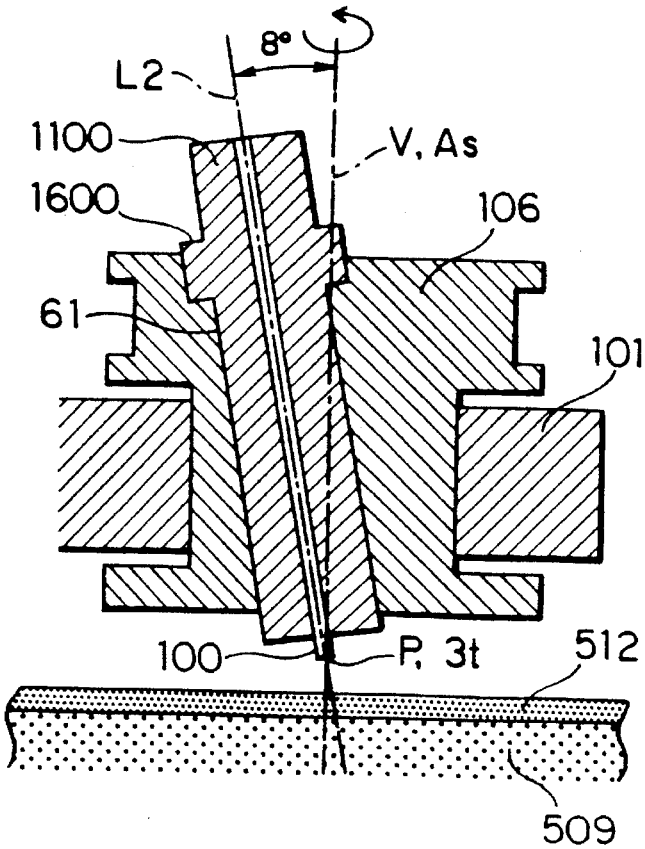
FIG. 14 is a cross section view in the vicinity of the reversible spindle used in the spherical surface polishing process.

Thereafter, as shown in FIG. 14, said collet chuck sleeve 1100 is inserted in the insertion hole 61. The key 1502 is engaged in the key slot 63, and the collet chuck sleeve 1100 and reversible spindle 106 are positioned. The optical axis L2 (same as the central axis L of the optical fiber insertion hole 4) of the optical fiber is inclined at an angle of 8° with respect to As, the axis of rotation of the reversing spindle 106, and said axis of rotation, As, coincides with the line V vertical erected on the polishing disc 509.

Next, an elastic abrasive disc 512 is mounted on said polishing disc 509.

The position of the end face of the ferrule 100 is adjusted using a collet chuck sleeve height-adjusting nut 160. Said position of the end face of the ferrule 100' is so adjusted that the point P (where the optical axis L2 of the optical fiber s intersects with the conical surface 3) of the optical fiber s coincides with the axis of rotation As of the reversible spindle 106. However, this adjustment can be made unnecessary if the heights of each component are set accurately beforehand.

Next, the power switch 111 is turned on to operate the reversible spindle 106, the elastic abrasive disc 512, and the jig plate shaking device 200 and alike.

The start switch 112 is turned on, the jig unit lowering/raising device 300 lowers the jig unit 1001 and the tip of the optical fiber assembly is brought in contact with the elastic abrasive disc 512 where it is polished.

Figure 15A:
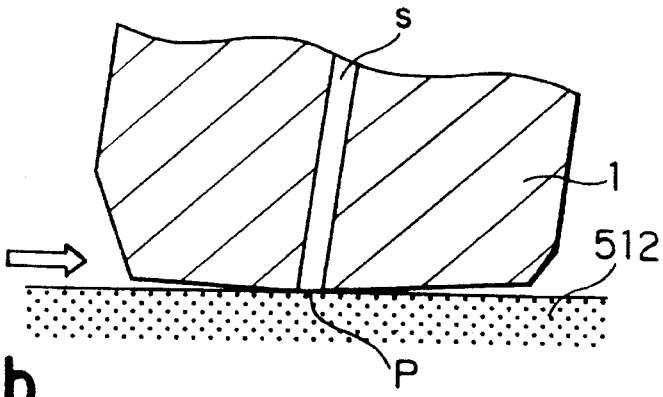
FIGS. 15(*a*)–(*b*) are cross section views used for explaining the spherical surface polishing process.
Figure 15B:
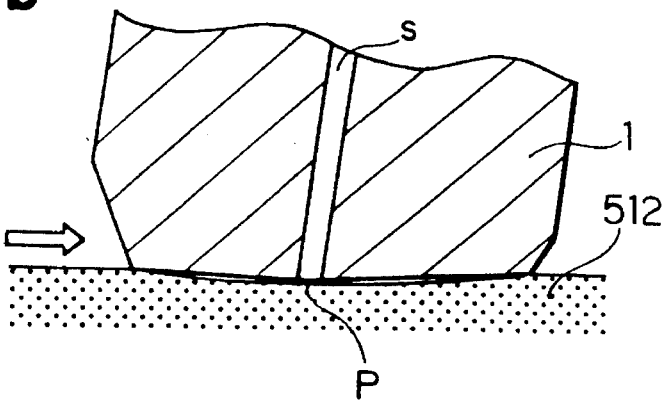

As shown in FIG. 15(*a*), since the end face of the ferrule 100 has a conical surface, the optical fiber s first comes in contact with the elastic abrasive disc 512 and it is polished. If the lowering of the jig unit 1001 is continued further, the elastic abrasive disc 512 becomes concave, as shown in FIG. 15(*b*), so that the corners of the ferrule 100 and optical fiber s come in contact with the elastic abrasive disc 512 and are polished. Thus in the present invention, polishing progresses at 3 locations, the central optical fiber and the two corners of the conical surface of the ferrule 100, unlike the conventional polishing process where the polishing progresses only at the two corners of the conical surface.

Figure 16:
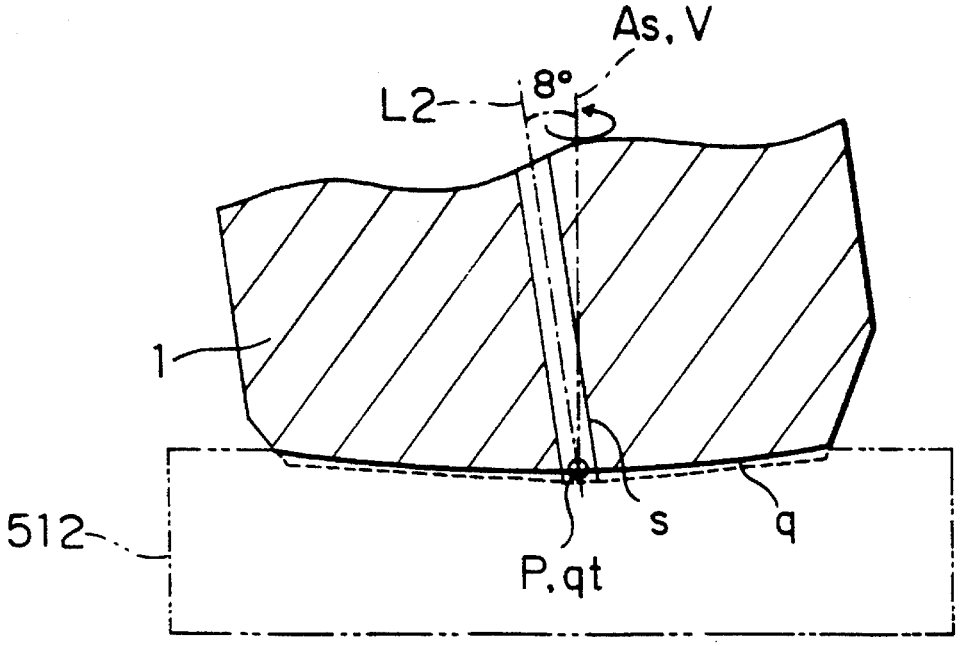
FIG. 16 is a cross section view after completion of the polishing process.
Figure 17:
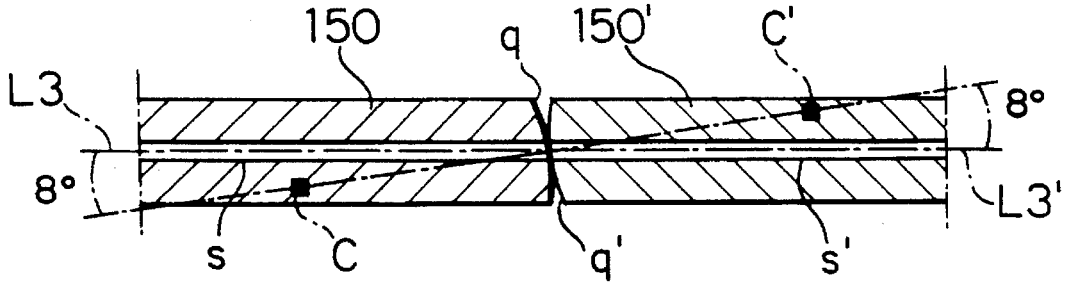
FIG. 17 PRIOR ART
FIG. 17 is an explanatory drawing showing the tips of optical fiber assemblies comprising of an optical fiber and a ferrule in the mutually-connected condition.
Figure 18A:
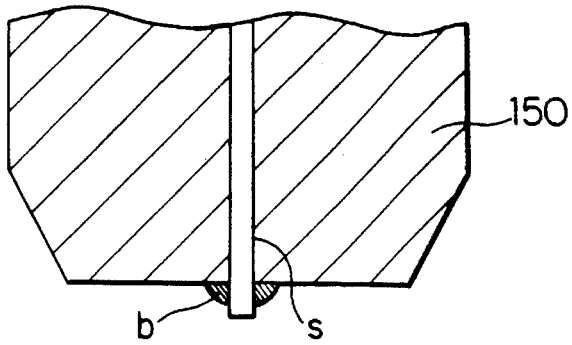
FIGS. 18(*a*)–(*b*) are explanatory drawings of the prior art of polishing the assembly consisting of an optical fiber and a ferrule.
Figure 18B:
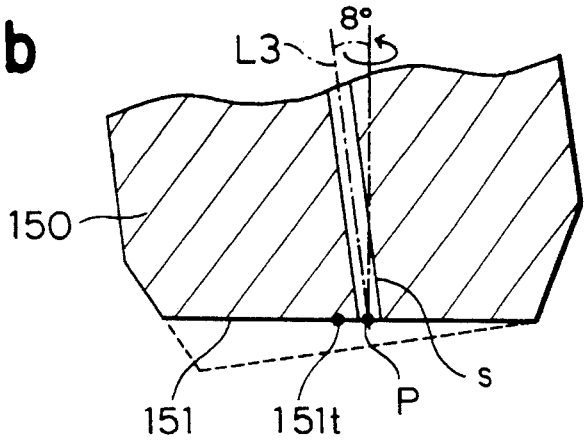
Figure 18C:
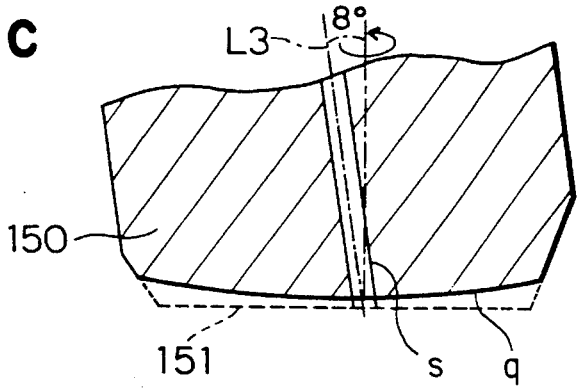
Figure 19:
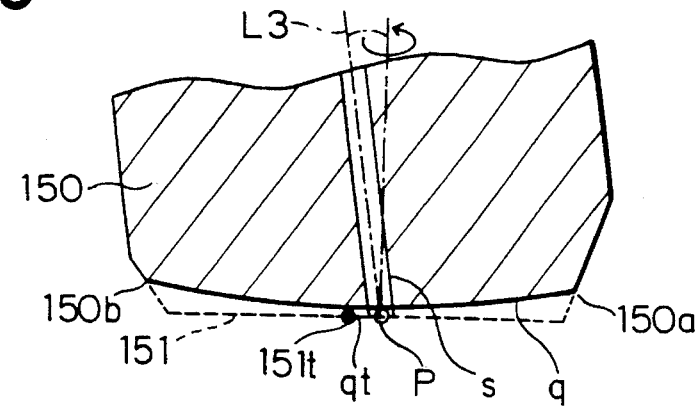
FIG. 19 is a cross section view of the tip of polished optical fiber assembly according to prior art.

Accordingly, as shown in FIG. 16, the oblique convex spherical surface q with a satisfactory balance is formed, and center point qt therein, is not offset from the optical axis point P, enabling insertion loss and light reflected back to the source to be stabilized and minimized.

In the aforementioned embodiment, the angle of inclination of the axis of rotation Ap of the oblique conical surface was taken as 2° with respect to the vertical line V erected on the polishing disc 509, however, any angle in the range 1.5° to 3° may be used. If the angle is smaller than 1.5°, there will be no change from the prior art. If the angle is larger than 3°, the amount to be polished from the central part of the optical fiber s increases, and the polishing time increases thereby. Furthermore, there is a possibility of damaging the elastic abrasive disc 512.

According to the end-face polished ferrule of the present invention, since the tip of said ferrule has been polished to an oblique conical surface, when the optical fiber is inserted, secured and polished to a spherical surface, an oblique convex spherical surface with satisfactory balance can be formed. Accordingly, the center of the oblique convex spherical surface is not offset from the point where the optical axis intersects with the end-face, and insertion loss and light reflected back to the source can be stabilized and minimized. Furthermore, during connection of the optical fiber, the advantage is that the optical fiber s can be inserted and polished to obtain a spherical surface, enabling the oblique conical surface polishing process to be eliminated on the user's side.

What is claimed is:

1. An end-face polished ferrule, polished to form a conical surface at the end face, such that;

central axis of said conical surface makes an inclination of θ° with respect to an axis of a optical fiber insertion hole, the top of said conical surface coincides with said axis of optical fiber insertion hole and has a taper angle of α°.

2. The end-face polished ferrule according to claim 1, wherein;

said inclination θ° is at least 8° and not more than 12°.

3. The end-face polished ferrule according to claims 1 or 2, wherein;

said angle α° is at least 1.5° and not more than 3°.

4. The end-face polished ferrule according to claims 1 or 2, comprising;

a flange with key slots for accommodating keys provided in a housing for said ferrule, wherein, plane containing said axis of optical fiber insertion hole and said central axis is either parallel or perpendicular to the plane containing said axis of optical fiber insertion hole and said key slots.

5. The end-face polished ferrule in claims 1 or 2, comprising;

a flange with four key slots spaced at 90° intervals for accommodating keys provided in a housing for said ferrule, wherein, the key slots facing each other having the same slot width while the key slots adjacent to each other having different slot width, and out of the two planes which contain the opposite key slots, one of the planes coincides with the plane containing said axis of optical fiber insertion hole and said central axis while the other plane is orthogonal thereto.

6. The end-face polished ferrule according to claim 5, wherein;

said key slots have two types of slot widths of 1.45 mm and 1.3 mm.

7. A method of manufacturing an end-face polished ferrule, wherein;

a spindle rotates around an axis of rotation which makes an angle of α° with respect to a line vertically erected on a plane polishing surface, and retains a ferrule with unpolished end face wherein an axis of a optical fiber insertion hole of said ferrule makes an inclination of θ° with respect to said axis of rotation, unpolished end face of said ferrule is brought into contact with said polishing surface and polished into a conical surface until the axis of optical fiber insertion hole of the ferrule coincides with the top of said conical surface.

8. The method of manufacturing an end-face polished ferrule according to claim 7, wherein;

said inclination θ° is at least 8° and not more than 12°.

9. The method of manufacturing an end-face polished ferrule according to claim 7 or claim 8, wherein;

said angle α° is at least 1.5° and not more than 3°.

* * * * *